US005161870A

United States Patent [19]

Mason et al.

[11] Patent Number: 5,161,870

[45] Date of Patent: Nov. 10, 1992

[54] FILE DRAWER HAVING REMOVABLE OUTER DRAWER HEAD

[75] Inventors: George L. Mason, Grand Rapids; Ralph C. Russo, Whitehall, both of Mich.

[73] Assignee: Westinghouse Electric Corp., Pittsburgh, Pa.

[21] Appl. No.: 753,140

[22] Filed: Aug. 30, 1991

[51] Int. Cl.[5] ..... A47B 88/00

[52] U.S. Cl. ..... 312/348.4

[58] Field of Search ..... 312/330.1, 348.4, 341.1

[56] References Cited

U.S. PATENT DOCUMENTS

| | | | |
|---|---|---|---|
| 1,136,071 | 4/1915 | Weiss | 312/348.4 |
| 1,172,189 | 2/1916 | Bauer | 312/348.4 |
| 3,024,075 | 3/1962 | Howe | 312/348.4 |
| 3,179,480 | 4/1965 | Brinker | 312/348.4 |
| 3,542,447 | 11/1970 | Himelreich | 312/330 |
| 3,752,553 | 8/1973 | Bildahl et al. | 312/330 |
| 3,933,402 | 1/1976 | Peterson | 312/330 |
| 4,090,757 | 5/1978 | Frey et al. | 312/330.1 |
| 4,902,080 | 2/1990 | Berger | 312/348.4 |

*Primary Examiner*—Joseph Falk

*Attorney, Agent, or Firm*—R. R. Studebaker

[57] ABSTRACT

A file drawer having a removable outer drawer head which includes a drawer body and an inner drawer head permanently secured to the drawer body. The drawer body and inner drawer head include retaining means and the removable outer drawer head includes securing means which coact to releasably retain the outer drawer head to the drawer body and the inner drawer head. The removable outer drawer head is retained in such a way as to obviate the need for hardware, tools or additional parts, either in securing or removing the outer drawer head to the drawer body and the inner drawer head.

1 Claim, 3 Drawing Sheets

FILE DRAWER HAVING REMOVABLE OUTER DRAWER HEAD

BACKGROUND OF THE INVENTION

1. Field of the Invention

This invention relates to drawers with removable front panels and, more particularly to a file drawer having a removable outer drawer head which is releasably retained and removably secured to a drawer body without the need for hardware and additional parts.

2. Description of the Related Art

Drawers with removable drawer fronts or panels are widely known in the art. However, these drawer fronts are secured to the drawer bodies by screws, latches, clips, or some other type of locking mechanism requiring a multiplicity of parts or hardware that must be separately manufactured and then assembled. These parts may also become unattached and misplaced and in general their construction and adjustment can become expensive.

U.S. Pat. No. 4,902,080 issued Feb. 20, 1990 to Berger entitled "Adjustable Drawer-Front Mount Assembly" is illustrative of a screw-mounted drawer front. U.S. Pat. No. 3,933,402 issued Jan. 20, 1976 to Peterson entitled "Drawer With Removable Front Panel" is illustrative of a latch member mounting means for attaching a drawer front to a drawer body. U.S. Pat. No. 3,752,553 issued Aug. 14, 1973 to Bildahl et al. entitled "Drawer With Snap-On Front Panel" utilizes clips to secure the drawer front to the drawer body. Finally, U.S. Pat. No. 3,542,447 issued Nov. 24, 1970 to Himeireich entitled "Drawer Construction" discloses locking members which are used to secure the drawer front to the drawer body.

In most conventional drawers, in the event that a drawer front becomes damaged, the whole drawer must usually be discarded or at the very least a new drawer front must be installed. This installation must usually be performed in the factory which may require days or weeks before a drawer front can be replaced.

Consequently, there exists a need to be able to easily replace a damaged or obsolescent drawer front on location without having to discard the entire drawer, without having to send the drawer to the factory in order to have a new drawer front installed and without having to deal with additional parts and hardware.

SUMMARY OF THE INVENTION

In accordance with the present invention, the foregoing deficiencies of prior art are obviated by providing a file drawer having a removable outer drawer head which includes a drawer body, an inner drawer head and a removable outer drawer head which is releasably retained and removably secured to the drawer body without the need for additional parts or hardware.

The file drawer having a removable outer head of this invention comprises a drawer body including an inner drawer head, an outer drawer head having securing means thereon for removably securing the outer drawer head to the drawer body and retaining means on the upper end of the inner drawer head and the underside of the drawer body. The retaining means on the upper end of the inner drawer head and the underside of the drawer body coact with the securing means on the outer drawer head so as to releasably retain the outer drawer head on the drawer body without the use of hardware or additional parts.

BRIEF DESCRIPTION OF THE DRAWINGS

While the specification concludes with the claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

The invention herein described provides a file drawer having a removable outer drawer head which is releasably retained and removably secured to the drawer body without the need for hardware or additional parts, thereby facilitating replacement of damaged or obsolescent drawer heads or fronts within an office location.

Figure 1:
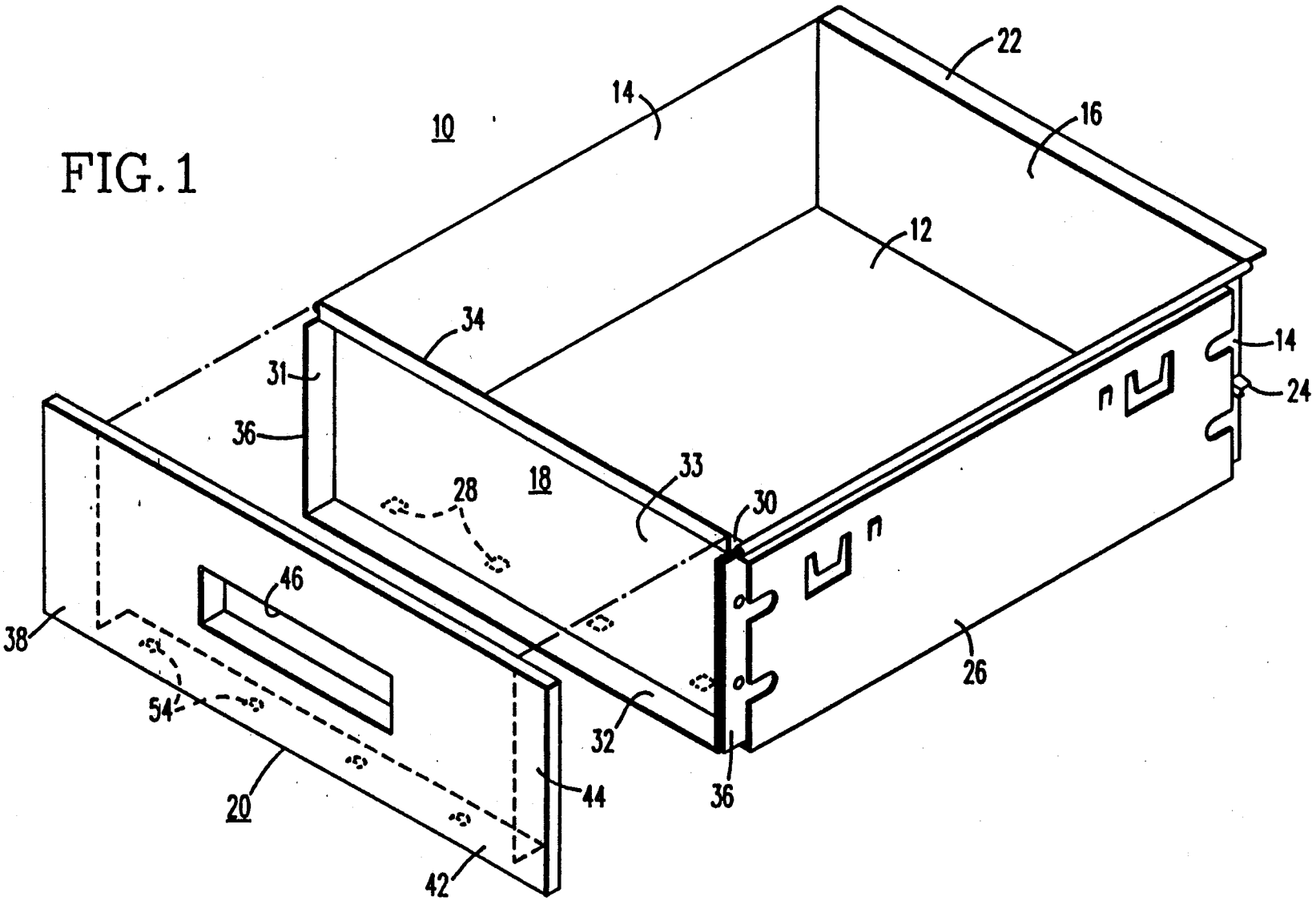
FIG. 1 is an exploded perspective view of a file drawer having a removable drawer head.

Referring now in detail to the drawings wherein like reference characters represent like parts throughout the several views, there is illustrated in FIG. 1 a drawer pan or body 10 which includes a bottom 12, side walls 14, a rear wall 16 and an inner drawer head 18 which is welded to the drawer body 10 to form a front wall thereby used to rigidify the drawer body 10 and also to retain the removable outer drawer front or head 20. The drawer body 10 also includes a flange 22 across the top of the rear wall 16 which acts as a drawer stop and side tabs 24 along the rear of either side wall 14 which act as catches to prevent the drawer body 10 from being pulled out onto a person's foot. The drawer body 10 further includes additional side walls or glide supports 26 which are welded to the side walls 14 of the drawer body 10 to provide added rigidity to the drawer body 10 and also to accommodate drawer glides (not shown). The bottom 12 of the drawer body 10 includes a plurality of slots 28 which are located directly behind where the inner drawer head 18 is welded to the drawer body 10.

The inner drawer head 18 comprises a one piece construction which is bent to include a top 30, sides 31, a bottom 32, and a rear side 33. The top 30 of the inner drawer head 18 includes retaining means in the form of an upwardly projecting flange 34 for use in retaining the outer drawer head 20 to the inner drawer head 18 and the drawer body 10. The inner drawer head 18 also includes forwardly projecting flange extensions 36 comprised of the sides 31 of the inner drawer head 18 and the side walls 14 of the drawer body 10 for use in centering the outer drawer head 20 on the inner drawer head 18 and the drawer body 10.

Figure 2:
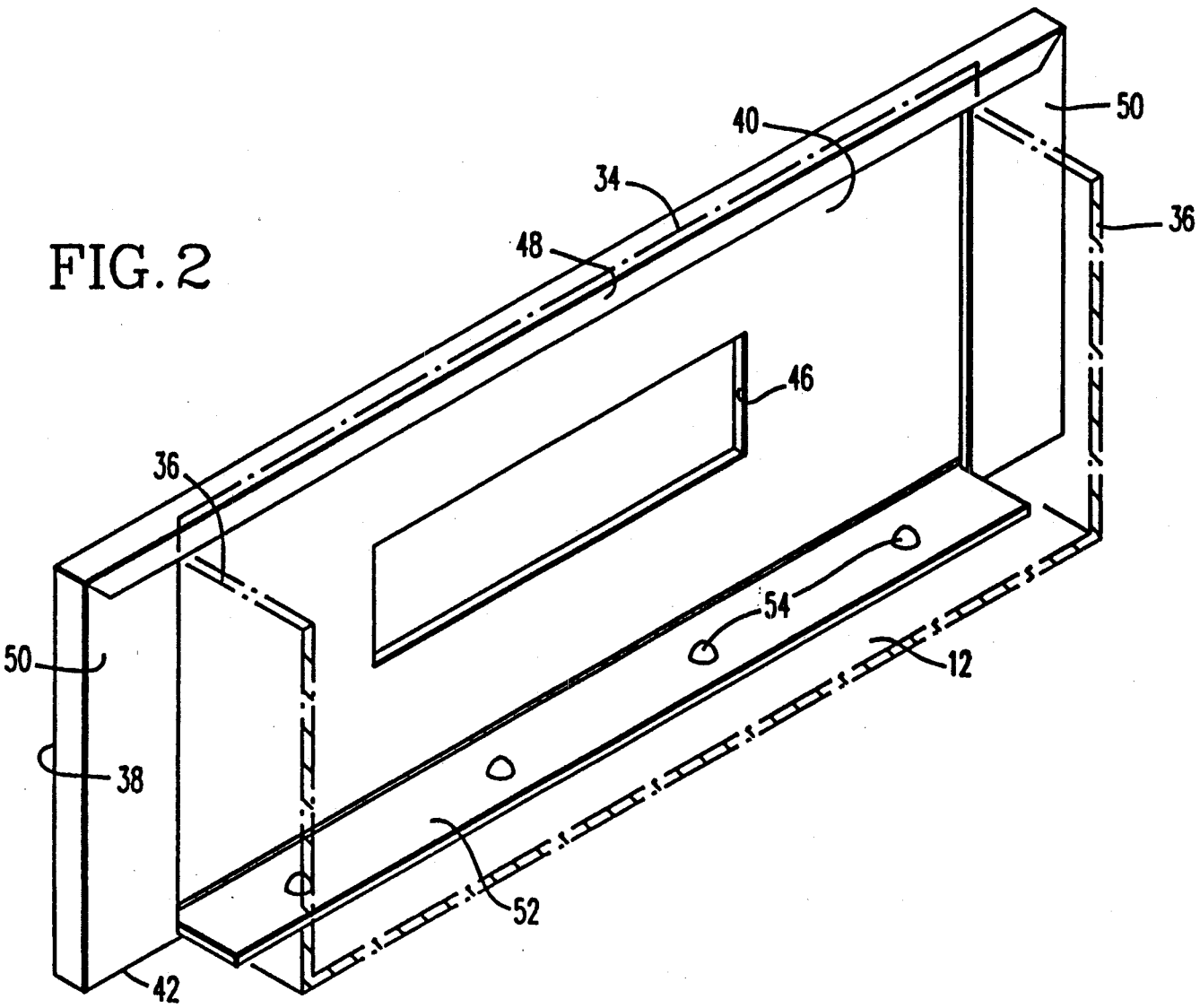
FIG. 2 is perspective view of the rear of the outer drawer head of this invention.

FIG. 2 illustrates the outer drawer head 20 comprising a one-piece construction having a front face 38, a back side 40, and a bottom edge 42. The front face 38 of the outer drawer head has a smooth flat surface 44 (FIG. 1) and a rectangular cut 46 in the center in order to accommodate a handle insert (not shown). The back side 40 is bent in such a way as to have a folded envelope appearance which includes securing means in the form of an L-shaped flange 48 across the top of the outer drawer head 20 and inwardly directed side flanges 50. The bottom edge 42 of the outer drawer head 20 comprises a rearwardly extending lip 52 which includes a plurality of upwardly projecting bosses 54 thereon.

Figure 3:
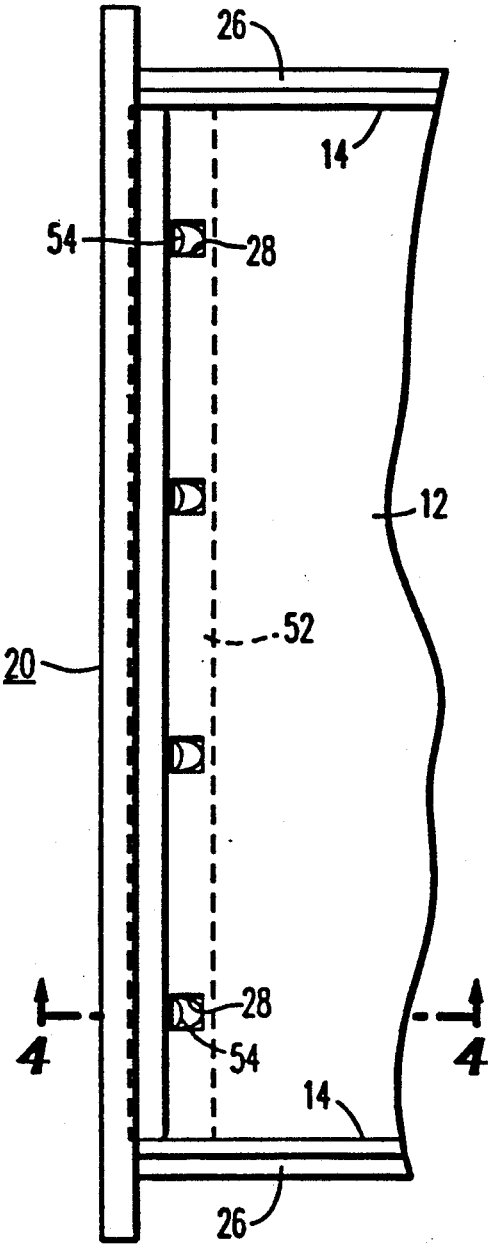
FIG. 3 is a bottom plan view of the front portion of the drawer body.
Figure 4:
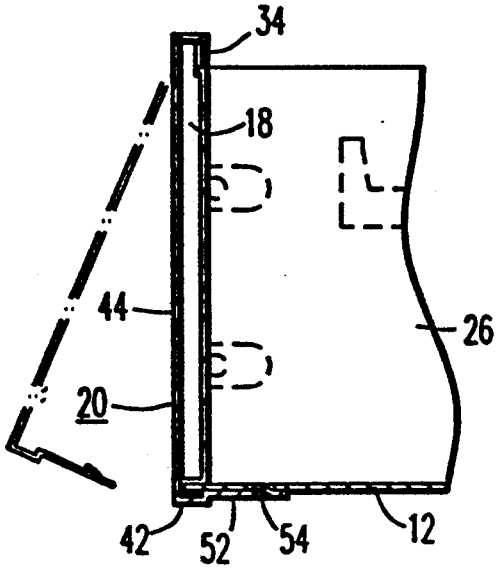
FIG. 4 is a sectional view of the outer drawer head secured to the drawer body, taken along the line 4—4 of FIG. 3.

As illustrated in phantom in FIG. 4, the outer drawer head 20 is secured to the drawer body 10 by inserting the L-shaped flange 48 of the outer drawer head 20 onto the upwardly projecting flange 34 of the inner drawer head 18 at an angle, then swinging the outer drawer head 20 downward so that the outer drawer head 20 is flush with the inner drawer head 18. The forwardly projecting flange extensions 36 of the inner drawer head 18 coact with the inwardly directed side flanges 50 of the outer drawer head 20 in order to center the outer drawer head 20 on the inner drawer head 18. The outer drawer head 20 is then snapped into place on the drawer body 10 by directing the rearwardly extending lip 52 located on the bottom edge 42 of the outer drawer head 20 along the bottom 12 of the drawer body 10. The plurality of upwardly projecting bosses 54 located on the rearwardly extending lip 52 of the outer drawer head 20 snap into the plurality of slots 28 located on the bottom 12 of the drawer body 10, thereby retaining and securing the outer drawer head 20 to the drawer body 10. An alternate embodiment would be to include the slots on the rearwardly extending lip of the outer drawer head and to include the bosses on the bottom of the drawer body for securing and retaining the outer drawer head to the drawer body by way of the slots and bosses coacting with each other in the same manner as described above. FIG. 3 is a bottom plan view of the bottom 12 of the drawer body 10 illustrating the outer drawer head 20 retained and secured to the drawer body 10 by way of the coaction of the plurality of slots 28 and the plurality of bosses 54.

To remove the outer drawer head 20 the user need only pull down on the rearwardly extending lip 52 of the outer drawer head 20 to disengage the bosses 54. The outer drawer head is then removed simply by pulling outward and upward to completely disengage the outer drawer head 20 from the inner drawer head 18 and the drawer body 10 without the need for additional parts or hardware.

Therefore, the invention provides a file drawer having a removable outer drawer head that is easily installed and removed without the need of any hardware, tools or additional parts thereby obviating the need to discard the entire drawer or to send the drawer to the factory for replacement of a new outer drawer head when the existing outer drawer head becomes damaged or obsolete.

We claim:

1. A file drawer comprising:

a removable outer drawer head including a front face, a back side, and a bottom edge, said front face having a smooth flat surface, said back side including a one-piece, L-shaped flange extending the entire length of the top of said outer drawer head and two inwardly directed one-piece side flanges extending the entire height of the sides of the outer drawer head, and said bottom edge having a one-piece, rearwardly extending lip, said lip including four equidistantly spaced, upwardly projecting bosses thereon; and a drawer body having a bottom, first side walls, a rear wall, and an inner drawer head permanently attached to said bottom and first side walls of said drawer body, said bottom including four equidistantly spaced slots which are adapted to receive said four equidistantly spaced bosses of said outer drawer head, said first side walls including one-piece forwardly projecting flange extensions for receiving said inwardly directed side flanges of said outer drawer head in order to center said drawer head on said drawer body, and additional side walls attached to said first side walls to provide rigidity to said drawer body and facilitate attachment of snap-in drawer glides, said rear wall including a one-piece rearwardly projecting flange extending the entire length of the rear wall for use as a drawer stop and said inner drawer head including an upwardly directed flange constructed and arranged to receive said L-shaped flange of said outer drawer head thereby releasably retaining said outer drawer head to said drawer body.

* * * * *